US010905189B2

(12) United States Patent
Bruce et al.

(10) Patent No.: US 10,905,189 B2
(45) Date of Patent: Feb. 2, 2021

(54) BRAIDED ARTICLE OF FOOTWEAR INCORPORATING FLAT YARN

(71) Applicant: NIKE, Inc., Beaverton, OR (US)

(72) Inventors: Robert M. Bruce, Portland, OR (US); Eun Kyung Lee, Beaverton, OR (US); James Y. Yoo, Portland, OR (US); Chikao Ichikawa, Gunma (JP); Michihiro Ichikawa, Gunma (JP)

(73) Assignee: NIKE, INC., Beaverton, OR (US)

( * ) Notice: Subject to any disclaimer, the term of this patent is extended or adjusted under 35 U.S.C. 154(b) by 174 days.

(21) Appl. No.: 15/991,846

(22) Filed: May 29, 2018

(65) Prior Publication Data

US 2018/0343959 A1 Dec. 6, 2018

Related U.S. Application Data

(60) Provisional application No. 62/513,229, filed on May 31, 2017.

(51) Int. Cl.
*A43B 1/04* (2006.01)
*D04C 3/18* (2006.01)
(Continued)

(52) U.S. Cl.
CPC ..... *A43B 1/04* (2013.01); *A43B 23/021* (2013.01); *A43B 23/024* (2013.01);
(Continued)

(58) Field of Classification Search
CPC ... A43B 1/04; A43B 23/0265; A43B 23/0205; A43B 23/0245; D04C 1/02; D10B 2501/043
See application file for complete search history.

(56) References Cited

U.S. PATENT DOCUMENTS 5,067,525 A 11/1991 Tsuzuki et al.
5,287,790 A 2/1994 Akiyama et al.
(Continued)

FOREIGN PATENT DOCUMENTS

EP 0806596 A1 11/1997
EP 2862969 A1 4/2015
(Continued)

OTHER PUBLICATIONS

International Preliminary Report on Patentability dated Dec. 12, 2019 in International Patent Application No. PCT/US2018/035426, 7 pages.
(Continued)

*Primary Examiner* — Shaun R Hurley
*Assistant Examiner* — Bao-Thieu L Nguyen
(74) *Attorney, Agent, or Firm* — Shook, Hardy & Bacon L.L.P.

(57) ABSTRACT

An upper for an article of footwear is provided, having a braided structure comprising a first yarn having a first cross-sectional shape and a second yarn having a second cross-sectional shape different than the first cross-sectional shape. The first cross-sectional shape comprises an outer surface parallel to an inner surface in a rectangular orientation. Additionally, the first yarn is oriented such that at least a portion of the outer surface comprises the first side of the first yarn and at least a portion of the inner surface comprises the second side of the first yarn.

20 Claims, 9 Drawing Sheets

(51) Int. Cl.

| | |
|---|---|
| ***A43B 23/02*** | (2006.01) |
| ***A43B 23/04*** | (2006.01) |
| ***D04C 1/02*** | (2006.01) |
| *D03D 3/02* | (2006.01) |
| *D03D 15/00* | (2006.01) |

(52) U.S. Cl.

CPC ..... *A43B 23/0205* (2013.01); *A43B 23/0245* (2013.01); *A43B 23/0265* (2013.01); *A43B 23/042* (2013.01); *D04C 1/02* (2013.01); *D04C 3/18* (2013.01); *D03D 3/02* (2013.01); *D03D 15/0083* (2013.01); *D10B 2501/043* (2013.01)

(56) References Cited

U.S. PATENT DOCUMENTS

| | | | | |
|---|---|---|---|---|
| 5,348,056 | A | 9/1994 | Tsuzuki | |
| 5,385,077 | A | 1/1995 | Akiyama et al. | |
| 5,415,204 | A | 5/1995 | Kitamura | |
| 6,024,005 | A | 2/2000 | Uozumi | |
| 6,161,399 | A * | 12/2000 | Jayaraman | D04B 1/14 623/1.5 |
| 9,295,575 | B1 | 3/2016 | Dignam et al. | |
| 10,060,056 | B1 | 8/2018 | Head et al. | |
| 10,455,885 | B2 * | 10/2019 | Tamm | A43B 5/02 |
| 10,499,707 | B2 * | 12/2019 | Hobson | A43B 1/04 |
| 10,555,581 | B2 * | 2/2020 | Bruce | D04C 3/48 |
| 2003/0089000 | A1 | 5/2003 | Tseng | |
| 2008/0110049 | A1 * | 5/2008 | Sokolowski | A43B 3/0031 36/50.1 |
| 2012/0271403 | A1 | 10/2012 | Gries | |
| 2013/0260104 | A1 | 10/2013 | Dua et al. | |
| 2013/0269209 | A1 * | 10/2013 | Lang | A43B 23/0235 36/45 |
| 2013/0305465 | A1 | 11/2013 | Siegismund | |
| 2014/0054214 | A1 | 2/2014 | Bator | |
| 2014/0137434 | A1 | 5/2014 | Craig | |
| 2014/0157974 | A1 * | 6/2014 | Cahuzac | D04C 3/00 87/33 |
| 2014/0196311 | A1 | 7/2014 | Follet et al. | |
| 2014/0196316 | A1 | 7/2014 | Follet | |
| 2014/0223671 | A1 | 8/2014 | Fisher et al. | |
| 2014/0310984 | A1 * | 10/2014 | Tamm | D04B 1/102 36/84 |
| 2014/0310986 | A1 * | 10/2014 | Tamm | A43B 1/00 36/84 |
| 2014/0373389 | A1 * | 12/2014 | Bruce | A43B 23/0215 36/87 |
| 2014/0377488 | A1 * | 12/2014 | Jamison | A43B 1/04 428/36.1 |
| 2015/0007451 | A1 * | 1/2015 | Bruce | A43B 23/0215 36/83 |
| 2015/0201707 | A1 | 7/2015 | Bruce | |
| 2015/0223552 | A1 * | 8/2015 | Love | A43B 1/04 36/134 |
| 2015/0272274 | A1 * | 10/2015 | Berns | A43B 23/0205 36/84 |
| 2016/0076178 | A1 | 3/2016 | Head et al. | |
| 2016/0095377 | A1 * | 4/2016 | Tamm | D04B 1/22 36/9 R |
| 2016/0168769 | A1 * | 6/2016 | McDonnell | D04C 3/48 87/9 |
| 2016/0213095 | A1 | 7/2016 | Kohatsu et al. | |
| 2016/0298267 | A1 * | 10/2016 | Feeney | D01D 10/04 |
| 2016/0309843 | A1 * | 10/2016 | Song | D03C 3/00 |
| 2016/0316855 | A1 * | 11/2016 | Berns | A43B 23/0205 |
| 2016/0316856 | A1 * | 11/2016 | Berns | A43B 23/0205 |
| 2016/0345676 | A1 | 12/2016 | Bruce et al. | |
| 2017/0021141 | A1 | 1/2017 | Osbrink et al. | |
| 2017/0156434 | A1 * | 6/2017 | Tamm | A43B 1/00 |
| 2017/0342612 | A1 | 11/2017 | Kawakami et al. | |
| 2018/0049509 | A1 * | 2/2018 | Zwick | A43B 23/0265 |
| 2018/0279720 | A1 * | 10/2018 | Iuchi | A43B 1/04 |
| 2018/0343957 | A1 | 12/2018 | Bruce et al. | |
| 2018/0343958 | A1 | 12/2018 | Bruce et al. | |
| 2018/0343960 | A1 | 12/2018 | Bruce et al. | |
| 2019/0017205 | A1 * | 1/2019 | Luedecke | A43B 1/04 |
| 2019/0110557 | A1 * | 4/2019 | Hobson | A43B 1/04 |
| 2019/0203389 | A1 * | 7/2019 | Liu | A43B 1/04 |
| 2019/0208862 | A1 * | 7/2019 | Poegl | A43B 23/0215 |
| 2019/0343216 | A1 * | 11/2019 | Huffa | A43B 13/38 |
| 2019/0350303 | A1 * | 11/2019 | Huffa | A43B 1/04 |
| 2019/0380424 | A1 * | 12/2019 | Tamm | A43B 1/04 |

FOREIGN PATENT DOCUMENTS

| | | | |
|---|---|---|---|
| GB | 410261 | A | 5/1934 |
| WO | 2014209596 | A1 | 12/2014 |
| WO | 2016093948 | A1 | 6/2016 |
| WO | 2016191478 | A1 | 12/2016 |
| WO | 2016196132 | A1 | 12/2016 |
| WO | 2017027284 | A1 | 2/2017 |
| WO | 2017027285 | A1 | 2/2017 |

OTHER PUBLICATIONS

International Preliminary Report on Patentability dated Dec. 12, 2019 in International Patent Application No. PCT/US2018/035116, 8 pages.

International Preliminary Report on Patentability dated Dec. 12, 2019 in International Patent Application No. PCT/US2018/035413, 9 pages.

International Preliminary Report on Patentability dated Dec. 12, 2019 in International Patent Application No. PCT/US2018/035113, 10 pages.

Final Office Action received for U.S. Appl. No. 15/991,844, dated May 6, 2020, 11 pages.

Non-Final Office Action received for U.S. Appl. No. 15/991,840, dated Apr. 3, 2020, 13 pages.

Non-Final Office Action received for U.S. Appl. No. 15/991,844, dated Jan. 24, 2020, 9 pages.

Non-Final Office Action received for U.S. Appl. No. 15/991,847, dated Mar. 19, 2020, 16 pages.

* cited by examiner

BRAIDED ARTICLE OF FOOTWEAR INCORPORATING FLAT YARN

CROSS-REFERENCE TO RELATED APPLICATIONS

This application is a non-provisional application which claims priority to U.S. Provisional Application No. 62/513,229. The entirety of the aforementioned application is incorporated herein by reference.

FIELD OF THE INVENTION

The present invention relates to an article of footwear, and in particular, an upper for an article of footwear.

BACKGROUND

Articles of footwear typically have an upper that provides an enclosure for receiving the foot of a wearer. It is desirable to have an upper construction that supports and protects a wearer's foot, yet also provides comfort for the wearer. Accordingly, shoe uppers may be created using a wide variety of materials and manufacturing techniques, in order to impart flexibility and aesthetic characteristics desired by the wearer of the upper.

One such technique available for manufacturing a shoe upper is braiding. However, due to previous limitations with braiding as a shoe upper manufacturing technique, braided shoe uppers typically incorporated yarns having a round cross-section.

DESCRIPTION OF THE DRAWINGS

Examples of the present invention are described in detail below with reference to the attached drawing figures, wherein.

DETAILED DESCRIPTION

Figure 1:
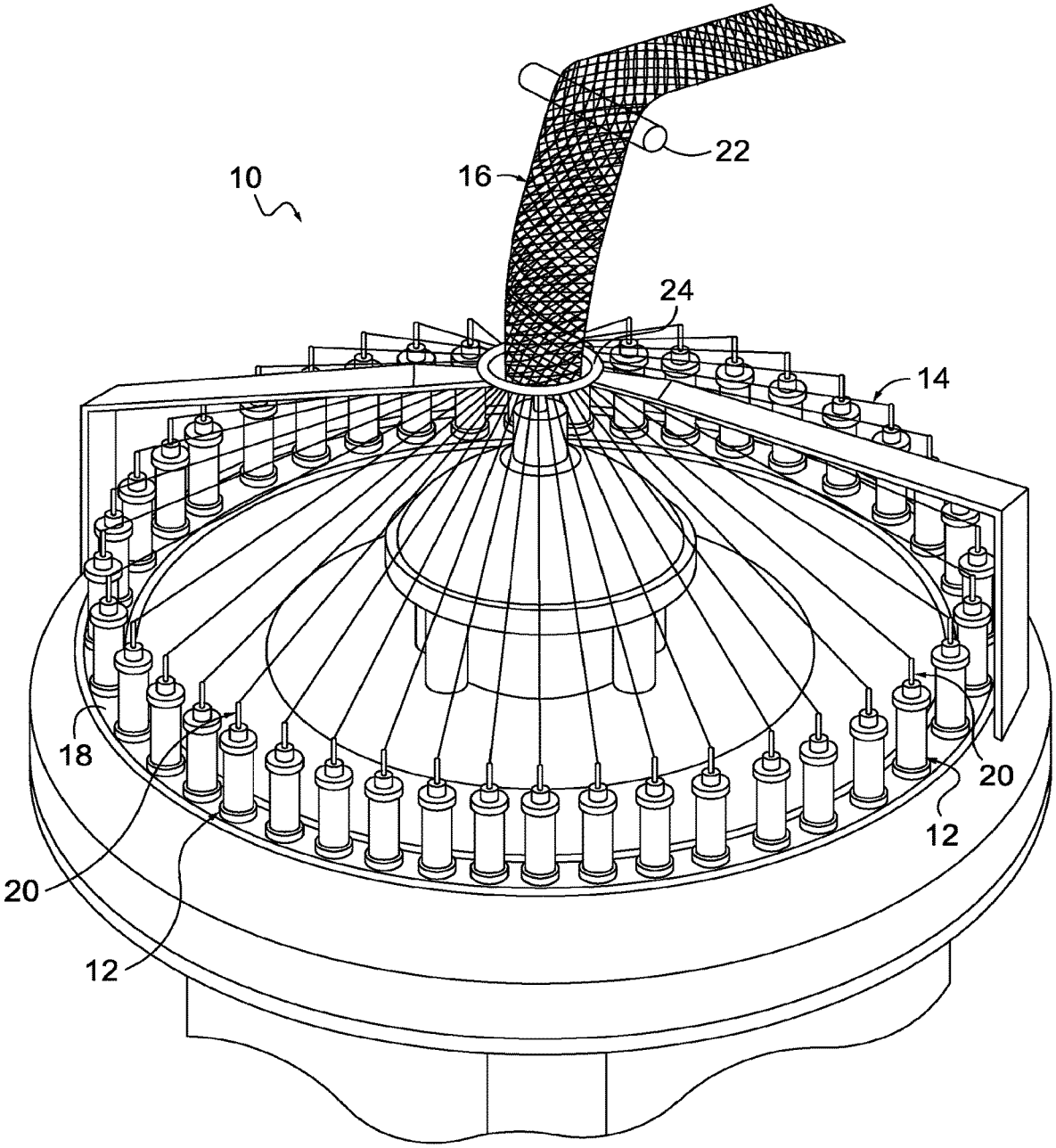
FIG. 1 depicts a schematic view of an exemplary braiding machine.

The subject matter of the present invention is described with specificity herein to meet statutory requirements. However, the description itself is not intended to limit the scope of this disclosure. Rather, the inventors have contemplated that the disclosed and claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to an upper for an article of footwear manufactured using a braiding technique. The upper for the article of footwear may incorporate yarn having a generally rectangular cross section, or as used throughout this disclosure, a "flat" yarn. As used throughout this disclosure, a "braided structure" generally refers to a structure in which three or more stands of material are combined with one another. The materials used to form the braided structure may be yarns, filaments, or other types of flexible material.

Creating a "braided structure" from three strands of flexible material can be incredibly time-consuming when done by hand. As such, automating the braiding process dramatically reduces the amount of time required to create one braided structure. However, limitations in the braiding process had previously imposed limits upon the shapes of yarns or filaments used in the braiding process. For example, due to the physical technique of braiding, yarns having a generally rectangular shape (i.e., flat yarns) were previously unsuitable for use in automated braiding. This is due to the fact that "flat yarns" typically contain a "first side", which has aesthetically appealing characteristics, and a "second side", which does not have aesthetically appealing characteristics. For these reasons, braided structures in footwear have not utilized away from "flat yarns", instead opting for yarn having a standard round cross-section (i.e., "round yarn").

Accordingly, aspects herein are directed to articles of footwear incorporating flat yarn into a braided structure. The article of footwear may incorporate both "round yarn" and "flat yarn" into the braided structure, in order to create an article of footwear having varied functional characteristics. Additionally, the braided structure of the article of footwear can incorporate flat yarns and round yarns into different portions, regions or zones of the braided structure, in order to vary the functional characteristics of each zone. In other words, various combinations of flat yarns and round yarns may produce zones having varying levels of elasticity. For example, in regions of the article of footwear in which a higher level of elasticity of preferred, the braided structure may incorporate different combinations of flat yarns and round yarn. The walking motion of a wearer tends to cause significant stress in the ankle, heel, toe and "ball" region of a human foot. Accordingly, when the article of footwear is in an as-worn configuration, the portions corresponding to the ankle, heel, toe and "ball" region of the human foot may be braided such that these regions have a higher level of elasticity. In some configurations, an article of footwear having varying levels of elasticity in separate zones tends to feel more comfortable to a wearer than an article of footwear having the same level of elasticity throughout.

Aspects herein are directed to an upper for an article of footwear. The upper may have a braided structure comprising an inner surface proximate an interior cavity of the article of footwear, an outer surface proximate an exterior of the article of footwear, a first yarn having a first cross-sectional shape, and a second yarn having a second cross-sectional shape different than the first cross-sectional shape. The first cross-sectional shape may comprise an outer surface parallel to an inner surface in a rectangular orientation, wherein the outer surface defines a first side and the inner surface defines a second side of the first yarn. Further, the first yarn may be oriented such that at least a portion of the outer surface comprises the first side of the first yarn and at least a portion of the inner surface comprises the second side of the first yarn.

In another aspect, an article of footwear is provided comprising a braided upper and a sole system, the braided upper and the sole system forming a toe end, an opposing heel end, a lateral edge, a medial edge, an opening, an interior cavity, an exterior surface, and an interior surface. The braided upper may further comprise a braided structure having a first yarn and a second yarn. The first yarn of the braided structure may be a flat yarn having a rectangular cross-section, the rectangular cross-section having a width between two edges and a thickness between a first side and a second side.

In yet another aspect, a method of making an article of footwear is provided. The method may further comprise forming a braided structure having an inner surface and an outer surface, the braided structure having a first yarn and a second yarn, wherein the first yarn of the braided structure is a flat yarn having a rectangular cross-section. The method may further comprise forming the braided structure into an upper, the upper having a toe end, an opposing heel end, a lateral edge, a medial edge, wherein the rectangular cross-section of the first yarn has a width and a thickness, and wherein the width of the rectangular first cross-sectional shape defines a first side and a second side of the rectangular first cross-sectional shape, and wherein the first side of the generally rectangular first yarn at least partially comprises the outer surface of the upper. Further, the method may comprise forming an opening into the braided structure, and coupling a sole system to the upper to form the article of footwear.

Braiding is a process of interlacing or interweaving three or more yarns diagonally to a product axis in order to obtain a thicker, wider or stronger product or in order to cover (overbraid) some profile. Interlacing diagonally means that the yarns make an angle with the product axis, which can be between 1° and 89° but is usually in the range of 30°-80°. This angle is called the braiding angle. Braids can be linear products (ropes), hollow tubular shells or solid structures (one, two or three-dimensional textiles) with a constant or variable cross-section, and of closed or open appearance.

As used herein, the yarns used for braiding may be formed of different materials having different properties. The properties that a particular yarn will impart to an area of a braided component partially depend upon the materials that form the yarn. Cotton, for example, provides a softer product, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the yarn selected for formation of a braided component may affect the properties of the braided component. For example, a yarn may be a monofilament or a multifilament. The yarn may also include separate filaments that are each formed of different materials. In addition, the yarn may include filaments that are each formed of two or more different materials, such as a bicomponent yarn with filaments having a sheath-core configuration or two halves formed of different materials.

As discussed herein, braided structures can be formed as tubular braids on a braiding machine, such as a radial, axial or lace braiding machine. One example of a lace braiding machine can be found in Ichikawa, EP 1 486 601, granted May 9, 2007 entitled "Torchon Lace Machine" and EP No. 2 657 384, published Oct. 30, 2013 entitled "Torchon Lace Machine," the entirety of which are hereby incorporated by reference. The upper portion of an exemplary braiding machine 10 is shown in FIG. 1. Braiding machine 10 includes a plurality of spools 12. In some embodiments, the spools 12 carry the yarn 14 selected for braiding. The yarns 14 from individual spools are selectively interlaced or intertwined with one another by the braiding machine 10. This interlacing or intertwining of strands forms a braided structure 16, as further described below. Each of the spools 12 is supported and constrained by a track 18 about the circumference of the braiding machine 10. Each spool 12 has a tensioner 20 (shown schematically in FIG. 1) that operates, along with a roller 22, to maintain a desired tension in the yarns 14 and the braided structure 16. As the yarns 14 extend upwardly, they pass through a braid ring 24 that is generally considered the braiding point. The braiding point is defined as the point or area where yarns 14 consolidate to form braid structure 16. At or near ring 24, the distance between yarns 14 from different spools 12 diminishes. As the distance between yarns 14 is reduced, the yarns 14 intermesh or braid with one another in a tighter fashion and are pulled linearly by roller 22.

Figure 2:
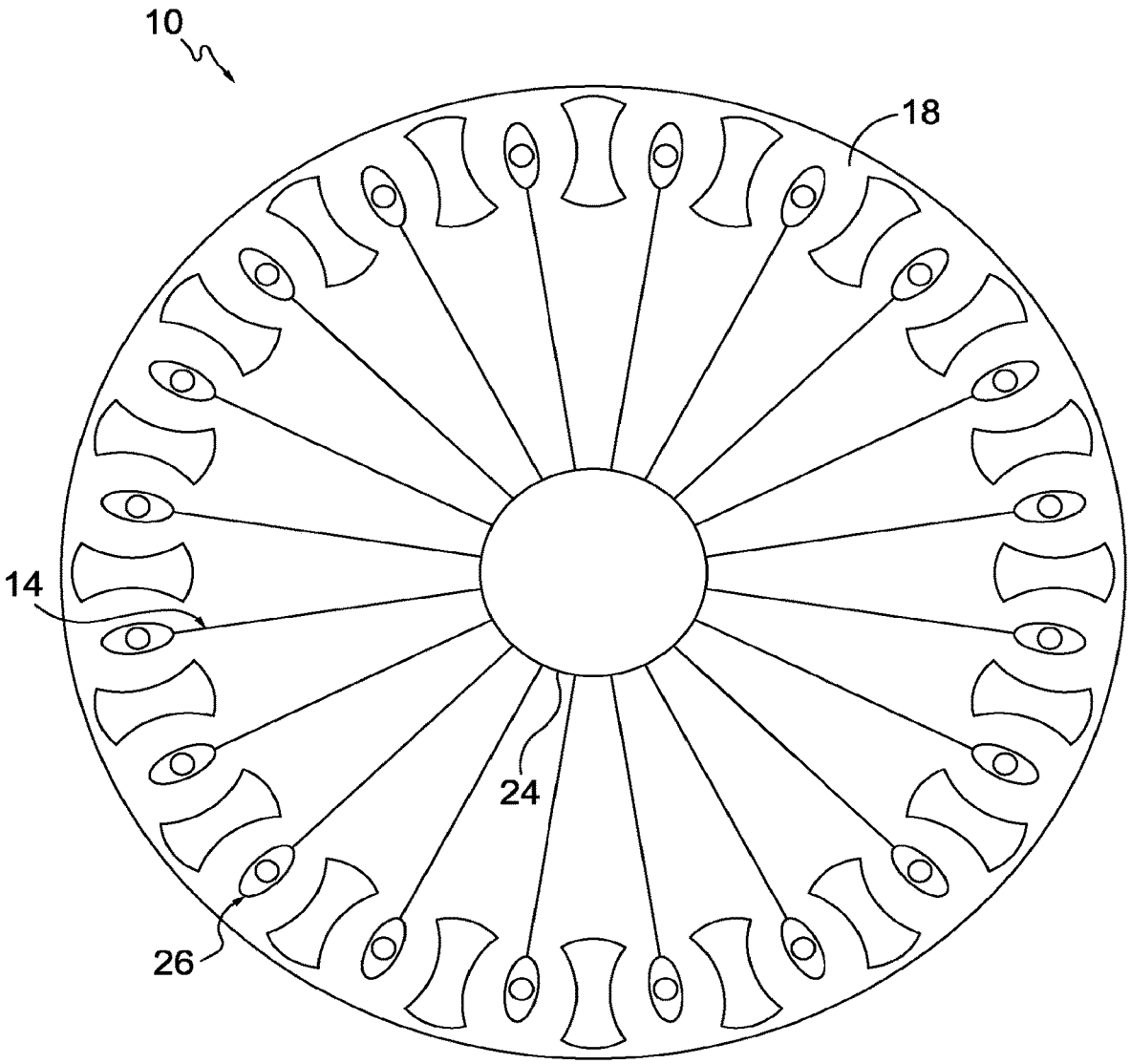
FIG. 2 depicts a schematic top view of an exemplary braiding machine, illustrating the carriages and rotor metals.
Figure 3:
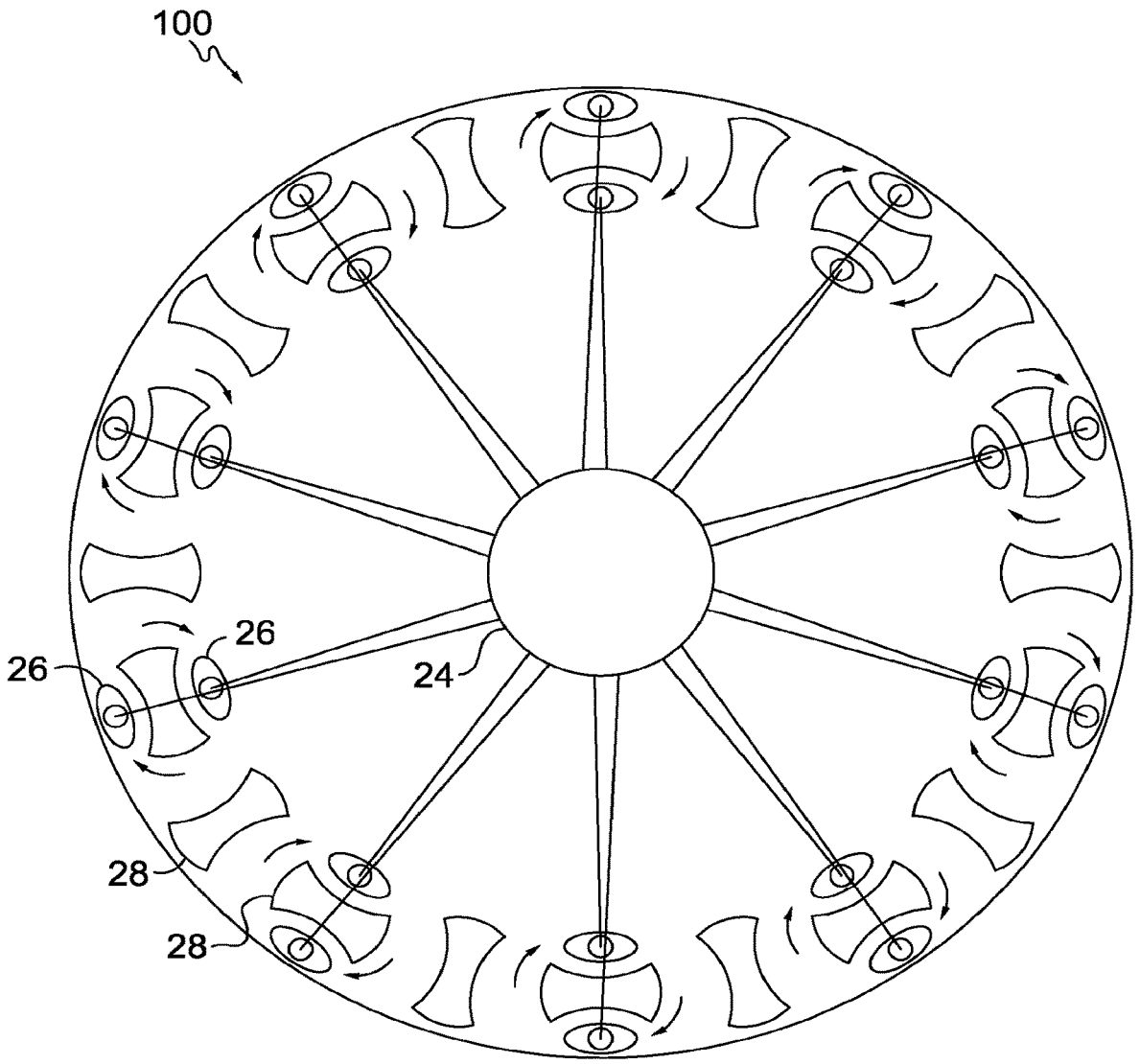
FIG. 3 depicts a view similar to FIG. 2, but with the rotor metals moving the carriages.

As best seen in FIG. 2, each spool 12 is carried and supported by a carriage 26. Each spool 12 is movable about the circumference of the track 18 by rotor metals 28. As described on the Torchon Lace Machine referenced previously, and disclosed in EP 1 486 601, each of the rotor metals 28 can be moved clockwise or counterclockwise. In contrast to radial braiding machines or fully non-jacquard machines, in a lace braiding machine, each rotor metal is not intermeshed with the adjacent rotor metal. Instead, each rotor metal 28 may be selectively or independently movable. As can be seen by comparing FIG. 2 to FIG. 3, as the rotor metals 28 rotate, they move the carriages 26, and thus the spools 12 supported on the carriages 26 by moving them about the circumference of the track 18. The braiding machine 10 is programmable such that the individual rotor metals 28 rotate the carriages 26, and thus the spools 12 to move them about the circumference of the track 18. As an individual spool 12 moves relative to an adjacent spool 12, the yarns 14 carried on the spools 12 interweave to create a desired braid pattern. The movement of spools 12 may be pre-programmed to form particular shapes, designs, and thread densities of a braided component or portions of a braided component. By varying the rotation and location of individual spools 12 various braid configurations may be formed. Such an exemplary braiding machine may form intricate braid configurations including both jacquard and non-jacquard braid configurations or geometries. Such configurations and geometries offer design possibilities beyond those offered by other textiles, such as knitting.

In some aspects, the size of braiding machine 10 may be varied. It should be understood that the braiding machine 10 shown and described is for illustrative purposes only. In some aspects, braiding machine 10 may be able to accept 144 carriages, although other sizes of braiding machines, carrying different numbers of carriages and spools is possible and is within the scope of this disclosure. By varying the number of carriages and spools within a braiding machine, the density of the braided structure as well as the size of the braided component may be altered.

Figure 5:
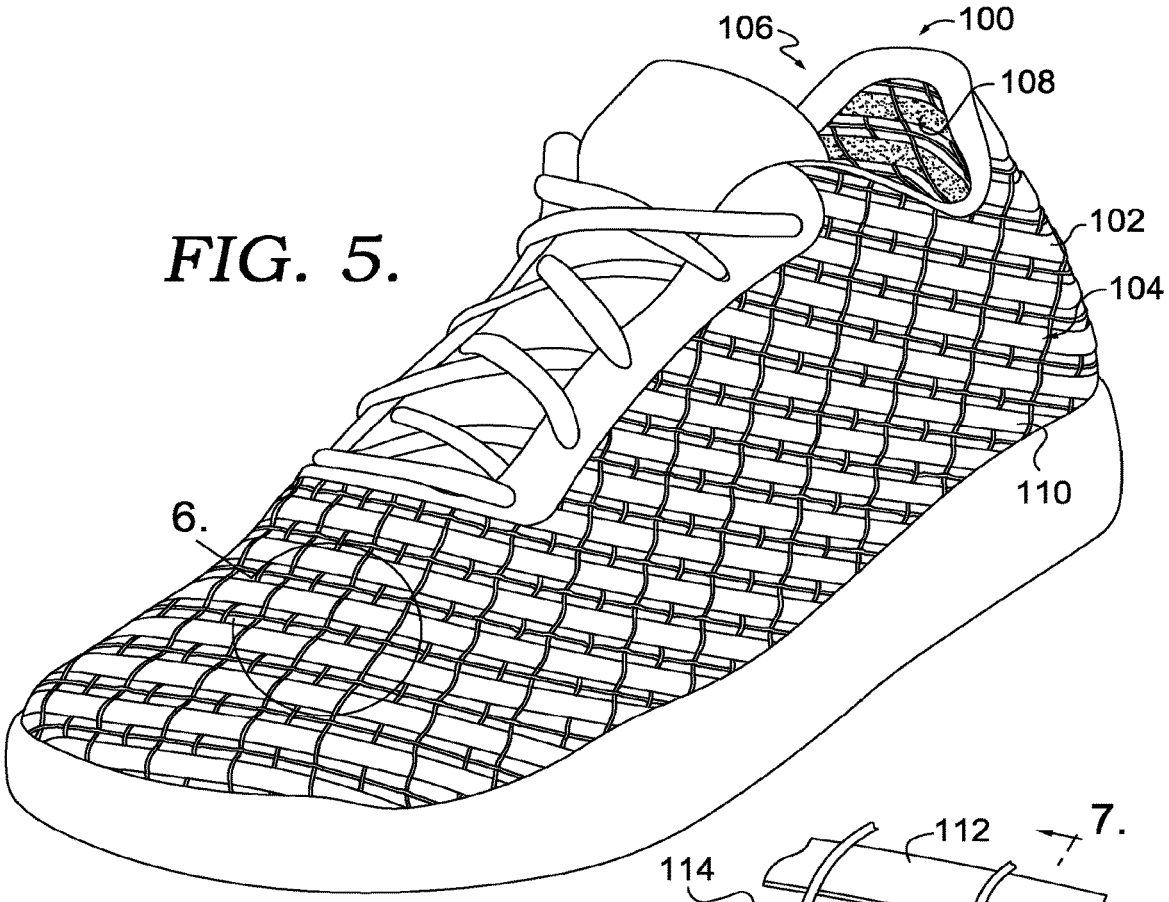
FIG. 5 illustrates a perspective view of an exemplary article of footwear having a braided structure, in accordance with an aspect herein.

Turning now to FIG. 5, a perspective view of an exemplary article of footwear 100 having a braided structure 104 is depicted. In FIG. 5, the article of footwear 100 is depicted generally as an athletic shoe, however this depiction is merely exemplary, and it is envisioned that the aspects described herein may be applied to various other kinds of footwear. For example, the aspects described herein may be applied to shoes for various types of sports, such as football, soccer, running, basketball, baseball, and the like. Additionally, it is contemplated that the aspects described herein may be applied to other types of footwear, such as boots, slippers, sandals, or high-heeled footwear. Further, it is contemplated that the aspects herein may be directed to articles other than footwear, such as shirts, shorts, pants, socks, gloves, headwear and the like.

In accordance with aspects herein, the upper 102 is generally referred to as the braided structure 104. As discussed previously, the term "braided structure" generally refers to a structure in which three or more strands of material are combined with one another. The materials used to form the braided structure may be yarns, filaments, or other types of flexible material. The upper 102 generally defines an interior cavity 106 for receiving and retaining the foot of a wearer. Further, the upper 102, and more specifically, the braided structure 104 further comprises an inner surface 108 and an outer surface 110. In accordance with aspects herein, the term "inner surface" generally refers to the inner surface 108 of the upper 102, while the term "outer surface" 110 generally refers to the outer surface of the upper 102. In other words, the inner surface 108 is generally positioned facing the interior cavity 106, while the outer surface 110 is generally positioned facing an exterior of the article of footwear 100.

Figure 6:
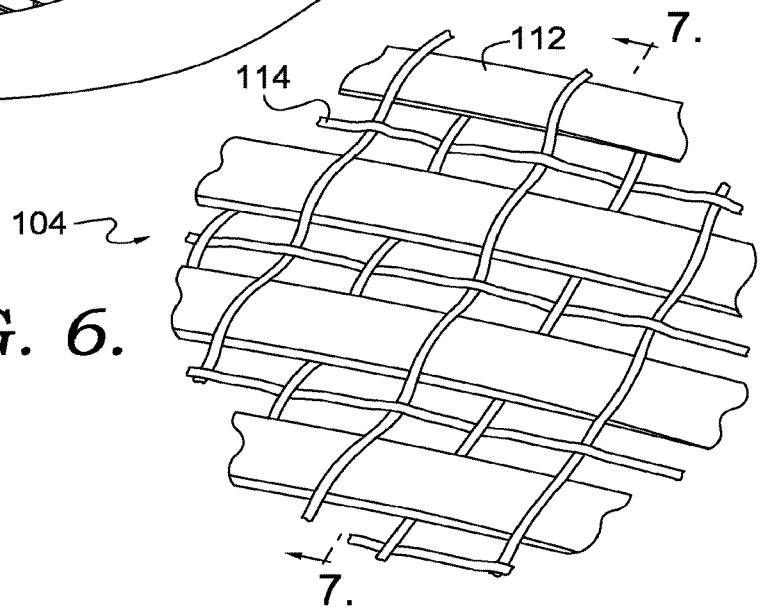
FIG. 6 illustrates a detailed perspective view of the braided structure of FIG. 5, in accordance with an aspect herein.

Turning now to FIG. 6, a perspective view of the braided structure 104 is depicted. In accordance with aspects herein, the view shown in FIG. 6 generally depicts the outer surface 110 of the braided structure 104. The braided structure 104 depicted in FIG. 6 is depicted as having a first yarn 112 and a second yarn 114. In accordance with aspects shown in FIG. 6, the braided structure 104 comprises one strand of a first yarn 112 and two strands of a second yarn 114. As depicted in FIG. 6, the one strand of the first yarn 112 is generally referred to as a "flat yarn", i.e., a yarn having a rectangular cross section, while the two strands of the second yarn are generally referred to as a "round yarn", i.e., a yarn having a round cross section. The placement of the flat yarns and the round yarns depicted in FIG. 6 are merely exemplary, however, and the configurations of round yarns and flat yarns are variable to create a different stiffness or aesthetic look of the article of the braided structure 104. For example, the braided structure 104 may utilize two round yarns and one flat yarn, or the braided structure 104 may utilize one round yarn and two flat yarns. Additionally, the positions of the flat and round yarns are variable. For example, the locations of flat yarns and round yarns depicted in FIG. 6 may be swapped with each other to create various configurations of the braided structure 104.

Moreover, the yarns described herein may be natural leather or synthetic leather material, or any of other type of yarn material known to a skilled artisan, i.e., elastane, polyester or nylon. By utilizing the various types of yarn described above, it is envisioned that the first yarn may have a first modulus of elasticity and the second yarn may have a second modulus of elasticity, which is different than the first modulus of elasticity. This concept may be applied to any of the individual flat or round yarns of the braided structure 104, in order to create a braided structure 104 having varied elastic properties.

However, this configuration is merely exemplary, and any combination of first yarns 112 and second yarns 114 are considered to be within the scope of this disclosure. For example, the braided structure 104 may be formed of two strands of the first yarn 112 and one strand of the second yarn 114. Alternatively, the braided structure may be formed completely of the first yarn 112, or completely of the second yarn 114.

As discussed previously and as depicted in FIG. 7, the first yarn 112 comprises a first cross-sectional shape 116, which has a generally rectangular shape and orientation. For example, the first cross-sectional shape comprises an outer surface 110 positioned generally parallel to an inner surface 112, wherein the outer surface 110 defines a "first side" 120 and a "second side" 122. In accordance with aspects herein, it is desirable to have the first side 120 form the outer surface 110 of the braided structure 104, as the first side 120 has generally appealing aesthetic characteristics. Similarly, it is desirable to have the second side 122 form the inner surface 108 of the article of footwear, as the second side 122 has properties which may be less appealing for use as the outer surface 110 of the article of footwear 100. In other words, the first yarn is oriented such that the first side is braided proximate at least a portion of the exterior surface, which conversely means that the first yarn is also oriented such that the second side is braided proximate at least a portion of the interior cavity. For example, the "second side" of the flat yarn may have a rough or a coarse texture that would be aesthetically less appealing on the outer surface 110 of the article of footwear 100. However, this rough or coarse texture may prevent the foot of the wearer of the article of footwear 100 from relative movement within the article of footwear 100. With continued reference to FIG. 7, the flat yarn 116 has a first vertical edge **128*a* and a second vertical edge 128*b* defining a width 126 of the flat yarn 116. Further, the flat yarn 116 has a first horizontal edge 125*a* and a second horizontal edge 125*b* defining a thickness 124 of the flat yarn 116**.

Figure 4:
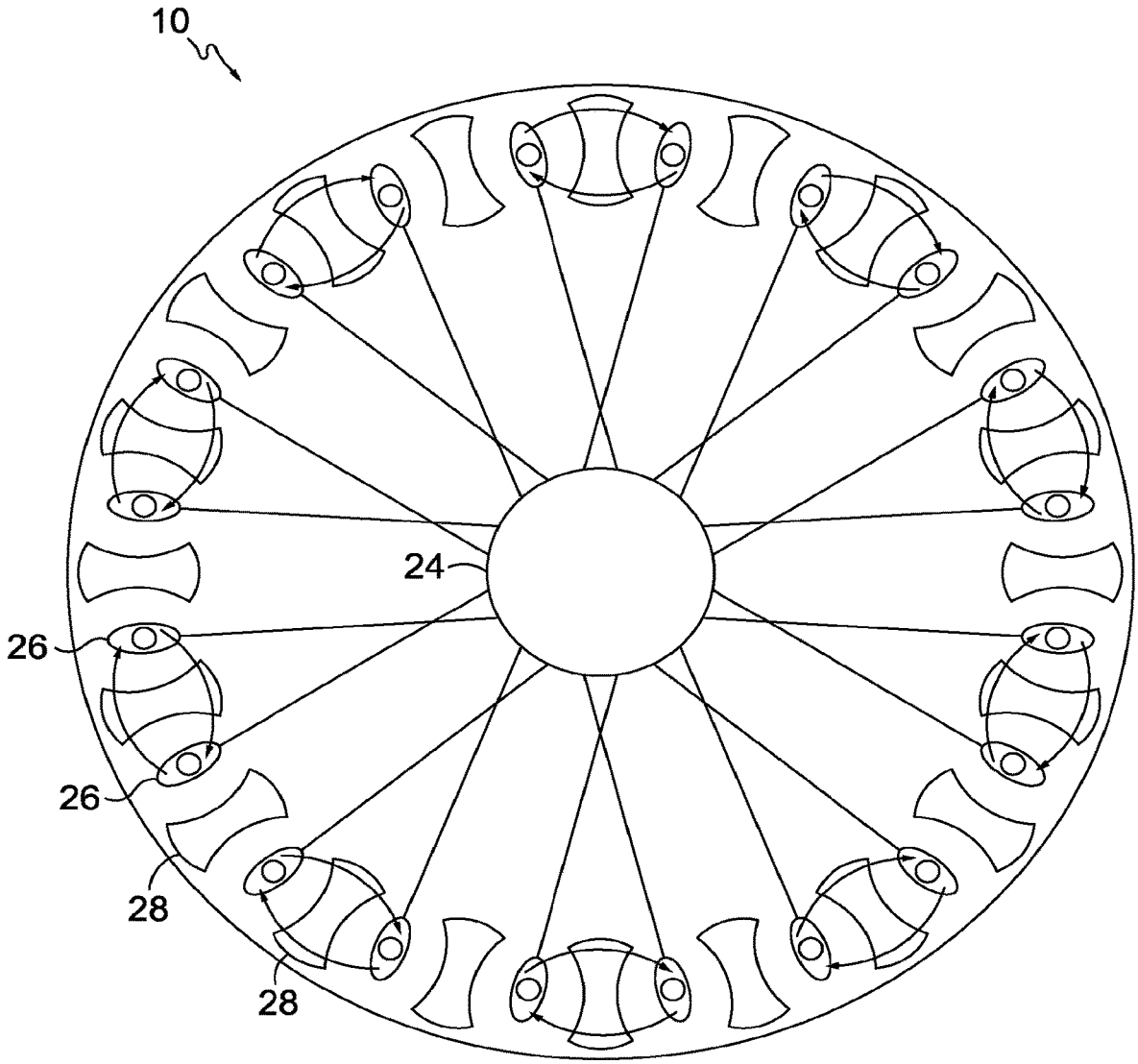
FIG. 4 depicts a view similar to FIG. 3, but showing the completion of the exemplary movement of FIG. 3.
Figure 8:
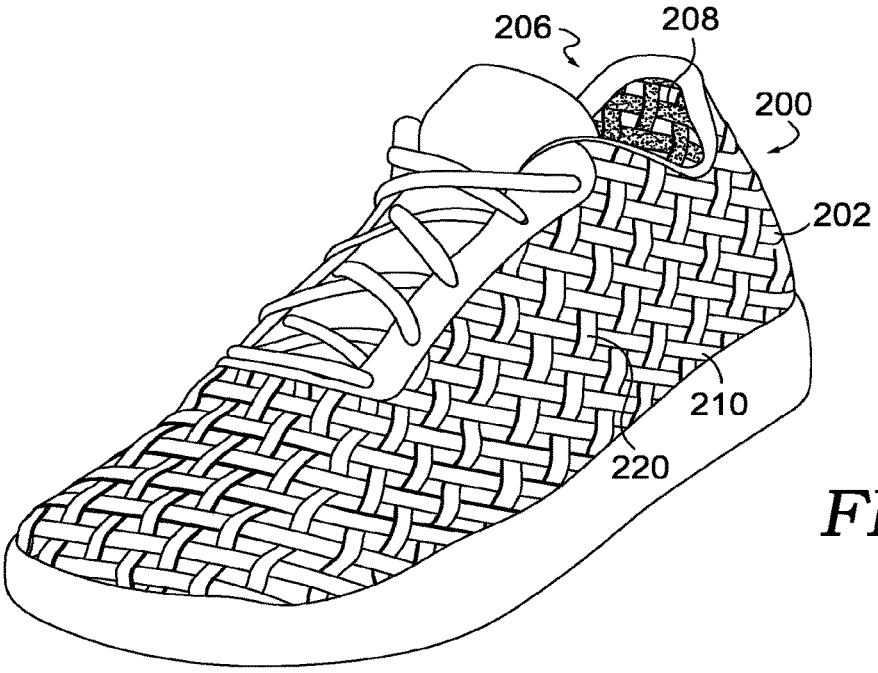
FIG. 8 illustrates an exemplary article of footwear having a braided structure in accordance with an aspect herein.

Turning now to FIG. 8, an exemplary article of footwear 200 is depicted as being braided exclusively using flat yarn. For example, when viewing FIG. 4 in conjunction with FIG. 5, the braided structure 204 of the article of footwear 200 utilizes flat yarn in all directions of the braided structure 204. In accordance with aspects herein, the term "flat yarn" is used to describe yarn having a rectangular cross-section, wherein a "flat yarn" comprises a width and a thickness.

Figure 9:
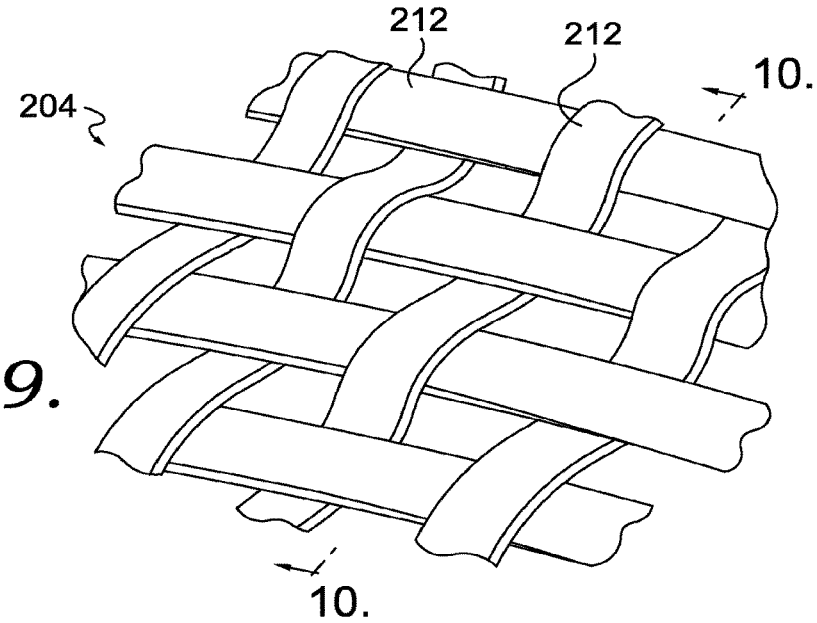
FIG. 9 illustrates a detailed perspective view of a braided structure incorporating flat yarn, in accordance with an aspect herein.
Figure 10:
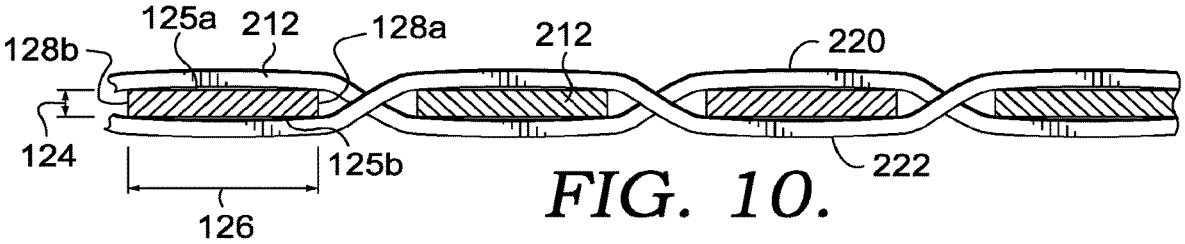
FIG. 10 illustrates a cross-sectional view of the braided structure of FIG. 9 taken along section line 9-9, in accordance with an aspect herein.

In general, the braided structure 204 has a smaller amount of "negative" space between each individual strand of the braided structure, when compared to the braided structure 104. In other words, the braided structure 204 covers a larger surface area of the foot of a wearer, when compared to the braided structure 104. In doing so, the article of footwear 200 may offer less ventilation compared to articles of footwear which utilizes yarns having both a circular cross-section and a flat cross-section. However, because the braided structure 204 covers a larger surface area of the foot compared to the braided structure 104, the braided structure 204 may offer additional protection of the foot for various athletic activities. In accordance with aspects herein, the braided structure 204 generally utilizes the "first side" and "second side" configuration depicted in FIG. 8. In other words, the braided structure 204 of FIGS. 8-10 depict that "first side" 220 forms the outer surface 210 of the braided structure 204. However, in accordance with aspects herein, there may be configurations in which is it desirable for the "second side" to partially or fully form the outer surface 210 of the braided structure 204.

Turning now to FIG. 10, a cross-sectional view of the braided structure 204 is depicted. As depicted in FIG. 10, the "first side" 220 of the braided structure generally refers to the superior surface of the braided structure, while the "second side" 222 of the braided structure generally references to the inferior surface of the braided structure 204. Further, as discussed with respect to FIGS. 8 and 9, the cross-sectional view of FIG. 10 depicts that the braided structure 204 utilizes flat yarn 212, i.e., yarn having a rectangular cross-section, for creating the braided structure 204. In accordance with aspects herein, the rectangular cross-sectional shape of the flat yarn may define the first side and the second side of the braided structure. Finally, and as discussed above, the flat yarn is generally incorporated into the braided structure such that the "first side" 220 forms an outer surface 210 of the braided structure.

Figure 7:
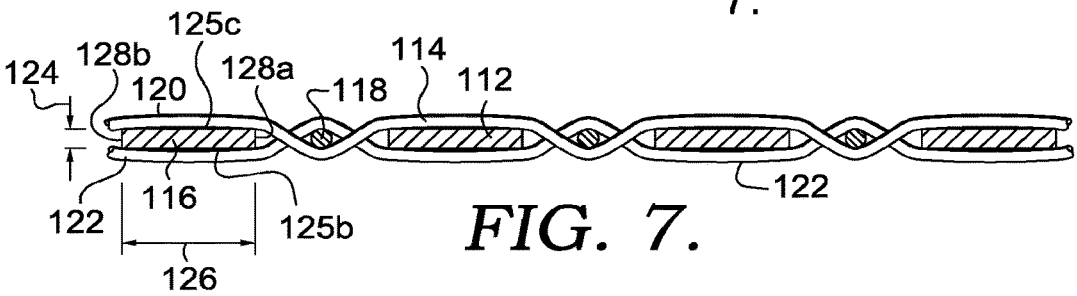
FIG. 7 illustrates a cross-sectional view of the braided structure of FIG. 6 taken along section line 7-7, in accordance with an aspect herein.
Figure 11:
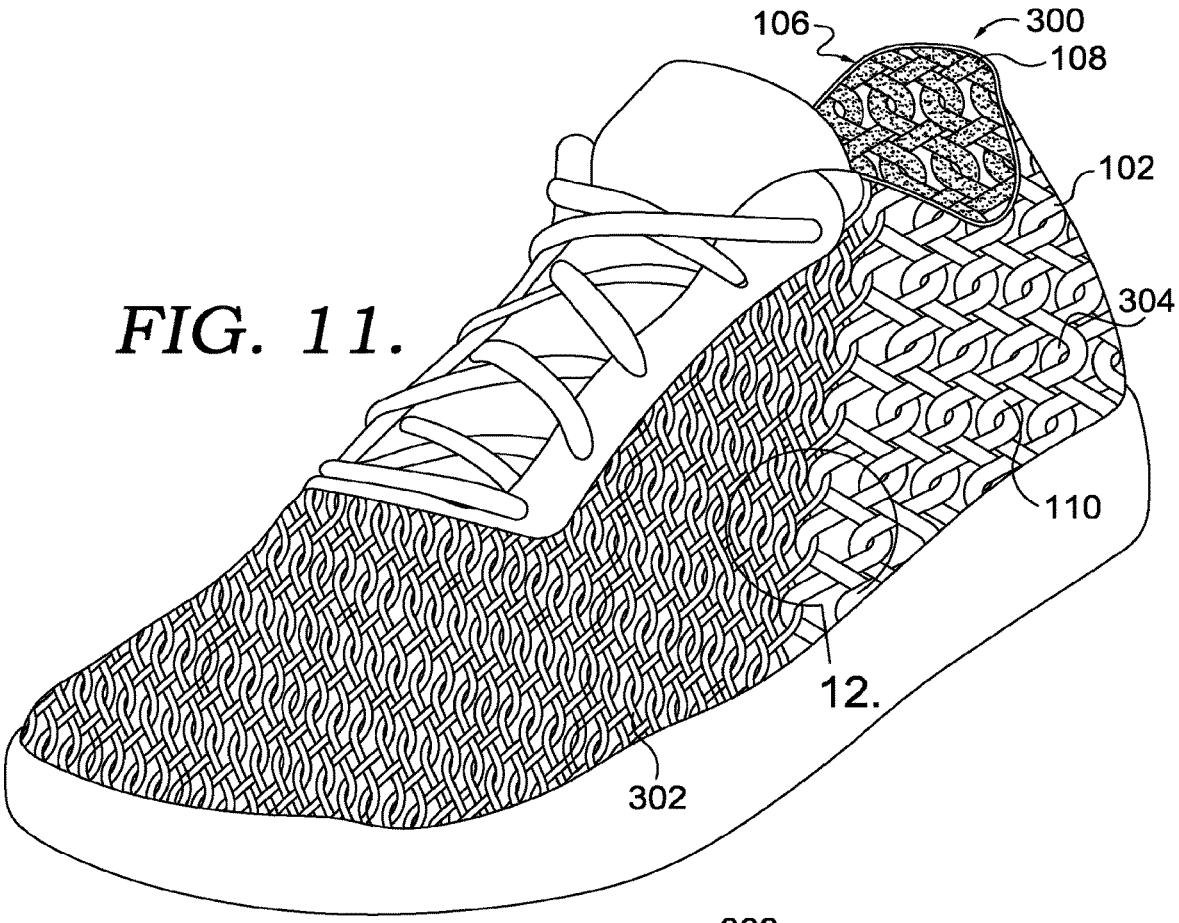
FIG. 11 illustrates a perspective view of the exemplary article of footwear having a braided structure, with a first zone and a second zone, in accordance with an aspect herein.

Turning now to FIG. 11, an exemplary article of footwear 300 is depicted as utilizing two different braiding structures. For example, the first braided structure 302 is depicted as utilizing both round yarns and flat yarns, similar to what is depicted in FIGS. 5-7, while the second braided structure 304 is depicted as utilizing only flat yarns, similar to what is depicted in FIGS. 8-10. In accordance with aspects herein, the first braided structure 302 may be referred to as a first zone having the first and the second yarn of the braided structure, wherein the second yarn is a round yarn having a circular cross-section. Additionally, the second braided structure 304 may be referred to as a second zone, wherein the third yarn of the second zone is the flat yarn, i.e., all of the yarns of the second zone are flat yarns.

In accordance with aspects herein, the placement of the first and second zones is variable depending on the desired functional aspects of the article of footwear 300. For example, the second braided structure 304, or the "second zone", may be located at a heel end of the article of footwear 300, as depicted in FIG. 11, or the second braided structure 304 may be located at a toe end of the article of footwear, as depicted in FIG. 11. As stated previously, it is desirable to locate the second zone, or the second braided structure 304, in an area of the article of footwear which requires additional stiffness or protective properties. Conversely, it is desirable to locate the first braided structure 302, or "first zone" in an area of the article of footwear which requires less stiffness or more breathability. In this sense, the second braided structure 304 may be defined as an area spaced apart a threshold distance from the opening 306 of the article of footwear 300. In other words, the desired placement of the first braided structure 302 and second braided structure 304 is dependent on the type of footwear for which the article of footwear 300 is intended. Accordingly, the second braided structure 304 may be placed between two zones of the first braided structure 302, in a "sandwich" orientation, while the first braided structure 302 may also be placed between two zones of the second braided structure 304. Additionally, in accordance with further aspects herein, the ratio of flat yarn to round yarn in the second zone may be between 1 to 1 and 1 to 5, although other ratios of flat yarn to round yarn are considered to be within the scope of this disclosure.

Figure 12:
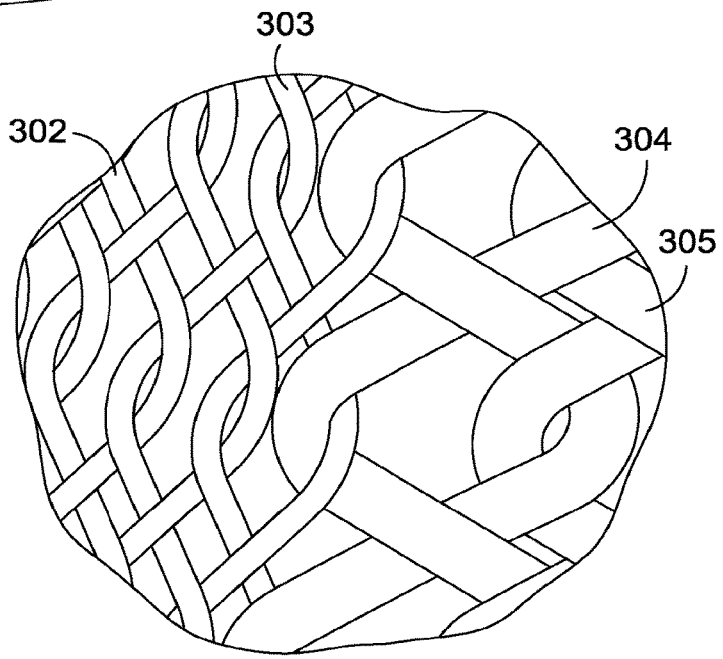
FIG. 12 illustrates a detailed perspective view of the transition between the first and second zones of the braided structure of FIG. 11, in accordance with an aspect herein.
Figure 13:
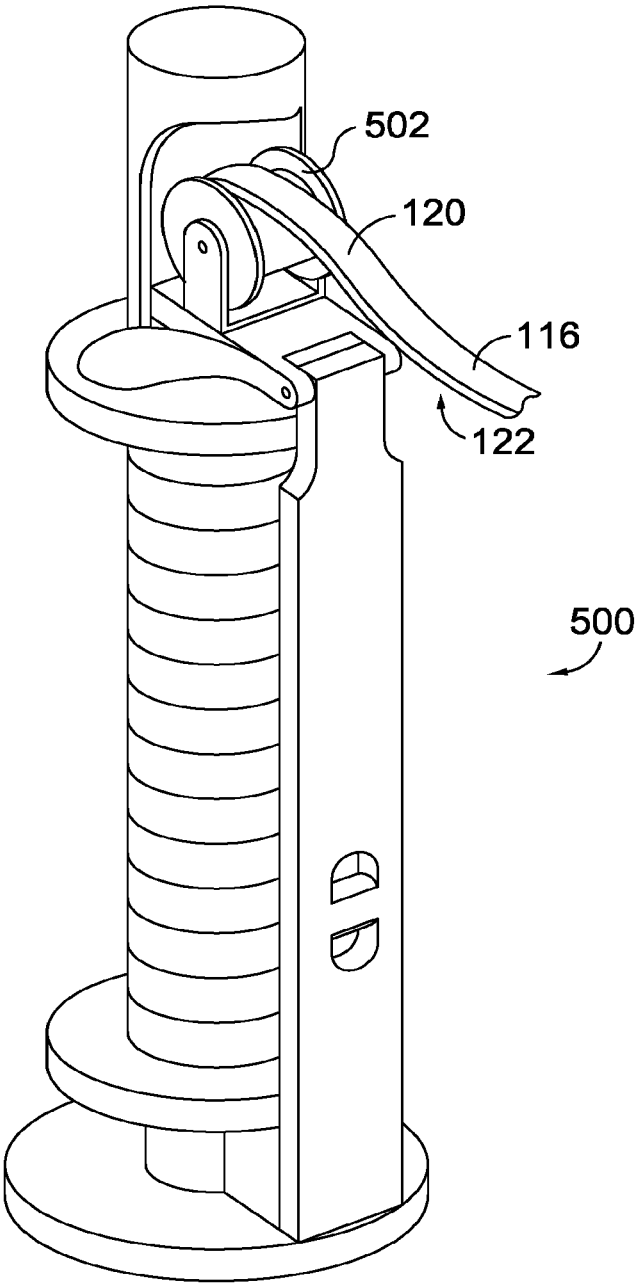
FIG. 13 illustrates a bobbin or spool having an exemplary roller coupled thereto for orientation of the flat yarn, in accordance with an aspect herein.

Turning now to FIG. 12, a detailed perspective view of the transition between the first braided structure 302 and the second braided structure 304 of FIG. 11 is depicted. In accordance with aspects herein, the flat yarn 305 of the second braided structure 304 is generally inter-braided with the round yarn 303 of the first braided structure. This transitional region is generally created when an automated braiding machine (not shown in FIG. 12) reaches the transition region as indicated in FIG. 11, then engages spools having the flat yarn as opposed to the round yarn. In order for the "first side" of the flat yarn to face the desired surface of the article of footwear 300, a roller may be coupled to a spool, such that the rotating aspect of the roller is positioned superior to the spool. The spool 500 is depicted in FIG. 13 as having a roller 502 coupled thereto, in which the "second side" 122 of the flat yarn is in contact with the roller, while the "first side" 120 of the flat yarn 116 faces away from the roller, such that the "first side" 120 forms an outer surface 110 of the article of footwear 100 (not depicted in FIG. 13).

Figure 14:
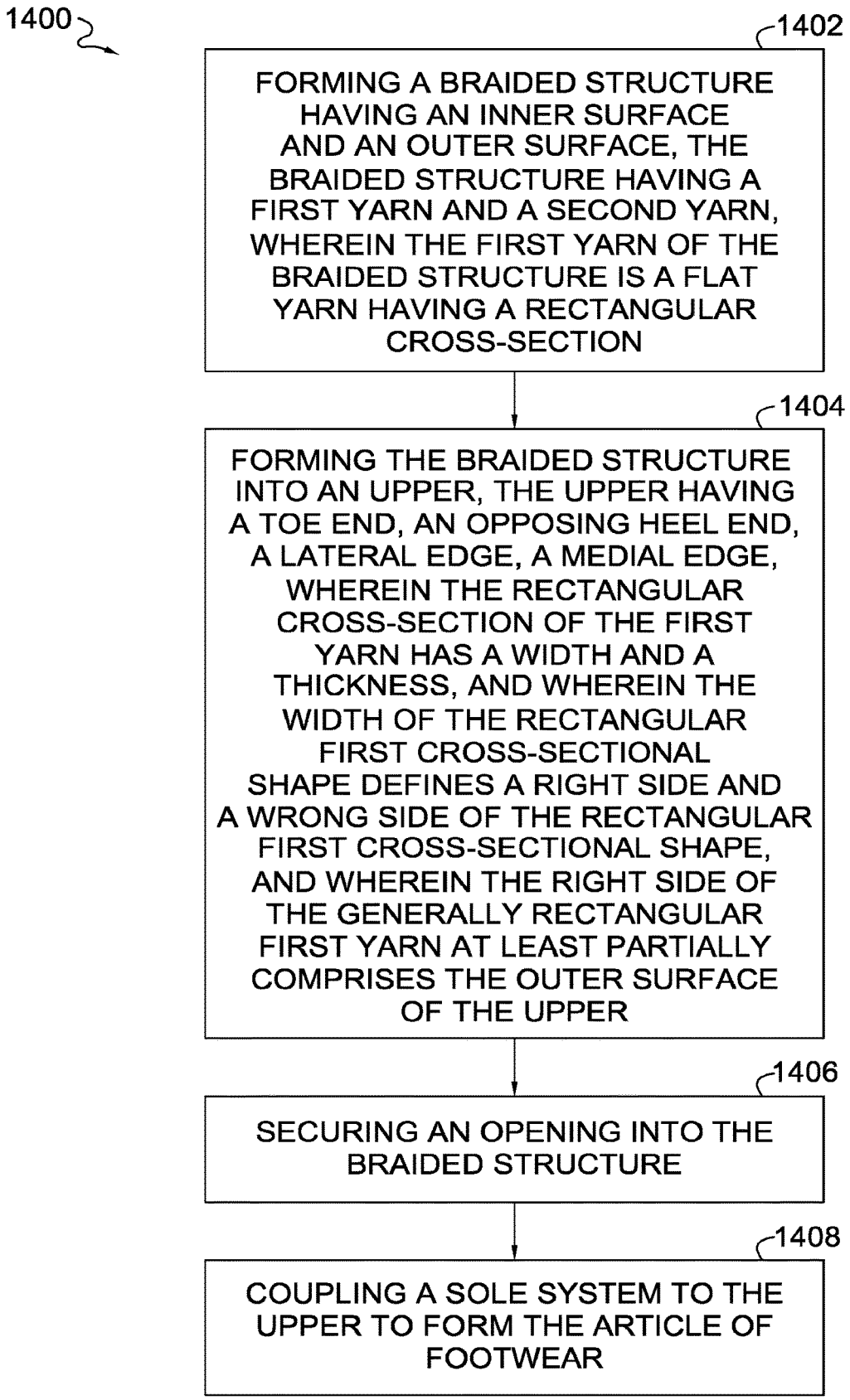
FIG. 14 illustrates a block diagram of an exemplary method of making an article of footwear, in accordance with an aspect herein.

Turning now to FIG. 14, a block diagram is shown of an exemplary method of making an article of footwear, in accordance with an aspect herein. Block 1402 depicts the step forming a braided structure having an inner surface and an outer surface. The braided structure has a first yarn and a second yarn, wherein the first yarn of the braided structure is a flat yarn with a rectangular cross-section. Next, block 1404 depicts forming the braided structure into an upper, the upper having a toe end, an opposing heel end, a lateral edge, and a medial edge, wherein the rectangular cross-section of the first yarn has a width and a thickness. The width of the rectangular first cross-sectional shape defines a first side and a second side of the rectangular first cross-sectional shape, and the first side of the generally rectangular first yarn at least partially comprises the outer surface of the upper. As discussed previously, a "roller" mechanism may be utilized to ensure that the first side of the flat yarn at least partially comprises the outer surface of the upper. Next, as shown as step 1406 securing an opening into the braided structure, and as shown in step 1408 a sole system is coupled to the upper to form the article of footwear, which may be done through bonding, adhesives, sonic welding and the like. Additionally, the sole may be physically coupled to the upper through physically interweaving or interbraiding the sole to the upper.

Examples of the present invention have been described with the intent to be illustrative rather than restrictive. Alternative examples will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims.

What is claimed is:

1. An upper for an article of footwear, the upper comprising:

a braided structure comprising an inner surface proximate an interior cavity of the article of footwear, an outer surface proximate an exterior of the article of footwear, a first yarn having a first cross-sectional shape, and a second yarn having a second cross-sectional shape, wherein the first cross-sectional shape comprises an outer surface parallel to an inner surface in a rectangular orientation, the outer surface defining a first side of the first yarn and the inner surface defining a second side of the first yarn, and further wherein the first yarn is a flat yarn having the first cross-sectional shape comprising a width and a thickness, wherein the width is greater than the thickness.

2. The upper of claim 1, wherein the width of the first cross-sectional shape defines the first side and the second side.

3. The upper of claim 2, wherein the braided structure is configured to maintain the inner surface proximate an inner surface of the upper, and further wherein the braided structure is configured to maintain the outer surface proximate an outer surface of the upper.

4. The upper of claim 1, wherein the second cross-sectional shape comprises an outer surface parallel to an inner surface in a rectangular orientation.

5. The upper of claim 1, wherein the second cross-sectional shape is round.

6. The upper of claim 1, wherein the first yarn is a natural leather or synthetic leather material.

7. The upper of claim 1, wherein the first yarn is an elastane or polyester.

8. The upper of claim 1, wherein the first yarn has a first modulus of elasticity and the second yarn has a second modulus of elasticity different than the first modulus of elasticity.

9. An article of footwear comprising:

a braided upper and a sole system, the braided upper and the sole system forming a toe end, an opposing heel end, a lateral edge, a medial edge, an opening, an interior cavity, an exterior surface, and an interior surface;

wherein the braided upper further comprises a braided structure having a first yarn and a second yarn, and wherein the first yarn of the braided structure is a flat yarn having a rectangular cross-section, the rectangular cross-section comprising a width and a thickness, wherein the width is greater than the thickness, and wherein the thickness is defined as a distance between a first side and a second side.

10. The article of footwear of claim 9, wherein the first yarn is oriented such that the first side is braided proximate at least a portion of the exterior surface.

11. The article of footwear of claim 10, wherein the first yarn is oriented such that the second side is braided proximate at least a portion of the interior cavity.

12. The article of footwear of claim 9, wherein the second yarn is a flat yarn having a rectangular cross-section.

13. The article of footwear of claim 9, wherein the second yarn is a round yarn having a circular cross-section.

14. The article of footwear of claim 9 further comprising:

a first zone having the first yarn and the second yarn of the braided structure, wherein the second yarn is a round yarn having a circular cross-section; and a second zone having the first yarn of the braided structure and further comprising a third yarn, wherein the third yarn of the second zone is a flat yarn.

15. The article of footwear of claim 14, wherein the second zone is located in the toe end or the opposing heel end of the article of footwear.

16. The article of footwear of claim 14, wherein the second zone is defined as an area spaced apart a threshold distance from the opening of the article of footwear.

17. The article of footwear of claim 14, wherein a ratio of flat yarn to round yarn in the second zone is between 1 to 1 and 1 to 5.

18. A method of making an article of footwear, comprising:

forming a braided structure having an inner surface and an outer surface, the braided structure having a first yarn and a second yarn, wherein the first yarn of the braided structure is a flat yarn having a rectangular cross-section;

forming the braided structure into an upper, the upper having a toe end, an opposing heel end, a lateral edge, a medial edge, wherein the rectangular cross-section of the first yarn has a width and a thickness, wherein the width is greater than the thickness, and wherein the width of the rectangular first cross-sectional shape defines a first side and a second side of the rectangular first cross-sectional shape, and wherein the first side of the rectangular cross-section of the first yarn at least partially comprises the outer surface of the upper, and further wherein the thickness of the first yarn is defined as a distance between the first side and the second side;

securing an opening into the braided structure; and coupling a sole system to the upper to form the article of footwear.

19. The method of claim 18, wherein the second yarn comprises a round yarn.

20. The method of claim 18, further comprising:

forming a first zone of the braided structure, the first zone having the first and the second yarn of the braided structure, wherein the second yarn is a round yarn having a circular cross-section; and forming a second zone of the braided structure, the second zone having the first yarn of the braided structure and further comprising a third yarn, wherein the third yarn of the second zone is the flat yarn.

* * * * *